US006481946B1

(12) United States Patent
Lonardi et al.

(10) Patent No.: US 6,481,946 B1
(45) Date of Patent: Nov. 19, 2002

(54) DEVICE FOR DISPENSING BULK MATERIALS

(75) Inventors: Emile Lonardi, Bascharage (LU); Giovanni Cimenti, Fentange (LU); Jean-Jacques Venturini, Obercorn (LU)

(73) Assignee: Paul Wurth S.A., Luxembourg (LU)

( * ) Notice: Subject to any disclaimer, the term of this patent is extended or adjusted under 35 U.S.C. 154(b) by 0 days.

(21) Appl. No.: 09/787,913

(22) PCT Filed: Oct. 5, 1999

(86) PCT No.: PCT/EP99/07352

§ 371 (c)(1),
(2), (4) Date: Jun. 26, 2001

(87) PCT Pub. No.: WO00/20646

PCT Pub. Date: Apr. 13, 2000

(30) Foreign Application Priority Data

Oct. 6, 1998 (LU) ..... 90294

(51) Int. Cl.[7] ..... B65G 65/28

(52) U.S. Cl. ..... 414/299; 414/160; 414/206

(58) Field of Search ..... 414/206, 160, 414/299

(56) References Cited

U.S. PATENT DOCUMENTS 3,899,088 A * 8/1975 Furuya et al. ..... 414/206
4,273,492 A * 6/1981 Legille et al. ..... 414/160
4,526,536 A * 7/1985 Legille et al. ..... 414/206 X

FOREIGN PATENT DOCUMENTS

| | | |
|---|---|---|
| EP | 0 863 215 | 9/1998 |
| FR | 2 692 595 | 12/1993 |
| LU | 82 173 | 5/1980 |

* cited by examiner

*Primary Examiner*—Steven A. Bratlie
(74) *Attorney, Agent, or Firm*—Oblon, Spivak, McClelland, Maier & Neustadt, P.C.

(57) ABSTRACT

The invention concerns a device for dispensing bulk materials through a rotary chute with variable angle of inclination comprising an underslung rotor mounted in a supporting frame so as to rotate about a substantially vertical axis of rotation. The chute is suspended from the rotor so as to pivot about a substantially horizontal axis of suspension. A mechanism for pivoting the chute comprises a hydraulic motor mounted on the underslung rotor. A hydraulic connecting device comprises a sleeve fixed in rotation and a rotary sleeve driven in rotation by the rotor. The sleeves co-operate to connect the hydraulic motor to a control hydraulic circuit fixed in rotation. A duct feeding the chute passes through the two sleeves. The device can advantageously equip a shaft furnace.

22 Claims, 7 Drawing Sheets

274
268
323
320
277
295
276
322
279
280
P
290
272
(T)
299
284
(P)
294
282
T
297
286
281
288
270
325
272
L
306
307
305
303
301
278
292
292'
42
288'
222
299'

DEVICE FOR DISPENSING BULK MATERIALS

The present invention relates to a device for distributing materials in bulk with a rotary chute having a variable angle of inclination.

BACKGROUND OF THE INVENTION

Field of the Invention

Such devices are used, for example, in devices for charging shaft furnaces, particularly blast furnaces, in which the rotary chute with a variable angle of inclination provides for the distribution of the charge inside the shaft furnace. More particularly, they comprise a supporting structure in which a suspension rotor is mounted in such a way that it can be driven in rotation about a substantially vertical rotation axis. The chute is suspended from this rotor so that it can be pivoted by a pivoting mechanism about its suspension axis. This pivoting mechanism makes it possible to change the inclination of the chute during its rotation. The rotor is traversed axially by a feed channel so that the materials in bulk, which flow from a batch hopper in the charging device, are poured into the rotary chute, which distributes them inside the shaft furnace.

Such devices for distributing materials in bulk are, for example, described in the documents WO 95/21272, U.S. Pat. Nos. 5,022,806, 4,941,792, 4,368,813, 3,814,403 and 3,766,868. In these devices, the pivoting mechanism comprises a second rotor, which has a rotation axis substantially coaxial with the first rotor, from which the chute is suspended. While the first rotor mainly gives the chute a rotation about a vertical axis, the second rotor interacts with the chute so as to determine its angle of inclination. For this purpose, the second rotor is connected to the chute by a mechanism converting a variation in angular displacement between the two rotors into a variation in the angle of inclination of the chute in its vertical pivoting plane. These devices were designed for large diameter blast furnaces. Their pivoting mechanism is too complicated and too expensive to equip small or medium-sized shaft furnaces.

An improved device for distribution material in bulk with a rotary chute having a variable angle of inclination, in which simpler means are used to change the inclination of the rotary chute and which ensure reliable operation, is needed.

SUMMARY OF THE INVENTION

A device of the present invention provides a suspension rotor mounted in a supporting structure so that it can rotate about a substantially vertical rotation axis. The chute is suspended from this suspension rotor so that it can pivot about a substantially horizontal suspension axis. The suspension rotor is traversed axially by a feed channel for the chute. It should be appreciated that the present invention proposes a very simple and very compact pivoting mechanism for changing the inclination of the chute in this way. This pivoting mechanism comprises a hydraulic motor, for example a hydraulic cylinder, which is mounted on the suspension rotor and connected to the chute so as to make it pivot about its suspension axis. An annular hydraulic connecting device is used to connect this hydraulic motor to a hydraulic control circuit. This hydraulic connecting device comprises more particularly a non-rotatable sleeve and a rotary sleeve driven in rotation by the rotor. The feed channel for the chute passes axially through these two sleeves, which cooperate in order to connect the hydraulic motor driven in rotation by the rotor to a non-rotatable hydraulic control circuit.

The annular hydraulic connecting device is preferably positioned above the supporting structure, which is designed as a leak-proof housing traversed in a gastight manner or almost in a gastight manner by the upper end of the rotor. This arrangement makes for easier maintenance and shields the connecting device from unfavourable environments (heat, corrosive smoke, vapours, dust) which may prevail inside the supporting structure.

In a first embodiment of the annular hydraulic connecting device, the rotary sleeve is supported by the rotor, and the non-rotatable sleeve is supported by the rotary sleeve. Bearings, comprising for example two bearing rings, may in this case support the non-rotatable sleeve on the rotary sleeve. A flexible annular expansion joint enables the non-rotatable sleeve to be connected in a gastight manner to the supporting structure, while allowing the non-rotatable sleeve small movements with respect to the supporting structure. It should be particularly appreciated that such an annular hydraulic connecting device is relatively insensitive to impacts experienced by the rotor.

In a second embodiment of the hydraulic connecting device, the non-rotatable sleeve is supported flexibly by said supporting structure and the rotary sleeve is supported by the nony, rotatable sleeve. In this embodiment, the non-rotatable sleeve and the rotary sleeve preferably have a fit designed in such a way that a pressurized hydraulic fluid injected between the two warrants a self-centering of the rotary sleeve in the non-rotatable sleeve. It should be appreciated that such a hydraulic connecting device requires fewer sealing joints between the two sleeves, which reduces the cost of the device and the maintenance expenses (fewer sealing joints to be replaced). The elimination of sealing joints between the two sleeves further means a considerable reduction in losses due to friction in the device, given that the power absorbed in a sealing joint may be as much as several kW.

For the transfer of the hydraulic liquid between the non-rotatable sleeve and the rotary sleeve, the hydraulic connecting device incorporates, for example, superposed supply channels. In a preferred embodiment, the drainage means are placed above and below these supply channels so as to collect the leakage flow from the adjacent supply channel. This leakage flow can then be used to supply at least one cooling circuit which is locked to the suspension rotor and rotates with it. In this case, the rotary sleeve advantageously includes a hydraulic circuit communicating with the drainage means and supplying at least one cooling circuit.

A tubular screen, non-rotatable and provided with a cooling circuit, is advantageously inserted between the feed channel and the rotary annular connecting device. This tubular screen is preferably supported by an outer wall of the supporting structure, so as to form with this outer wall an annular chamber in which the annular connection is housed.

In a preferred embodiment, the supporting structure is provided at its lower end with a fixed annular screen fitted with a cooling circuit and defining a circular central opening. The suspension rotor is then provided with a flange at its lower end. Said flange is fitted with clearance in the central opening of the fixed annular screen and has cavities opening into its lateral edge. A gas injection pipe is positioned along the free edge of the fixed annular screen so that a coolant gas can be injected into the cavities of the flange of the suspension rotor. It should be appreciated that such a system of fixed and mobile screens may be advantageously used in any device for distributing materials in bulk with a rotary chute having a variable angle of inclination in order to provide effective separation between the inside of the supporting structure and an unfavourable environment (for example: heat, corrosive smoke, vapours, dust) which may prevail under the supporting structure.

It should further be appreciated that the invention further provides a device for indicating the inclination of the chute. This device may be advantageously used in any device for distributing materials in bulk with a rotary chute having a variable angle of inclination.

BRIEF DESCRIPTION OF THE DRAWINGS

Other characteristics of the invention will emerge from the detailed description of a number of advantageous embodiments given below, as illustrative examples, making reference to the appended drawings. These drawings show.

DESCRIPTION OF THE PREFERRED EMBODIMENTS

In the figures, the same reference numbers indicate identical or similar elements.

Figure 1:
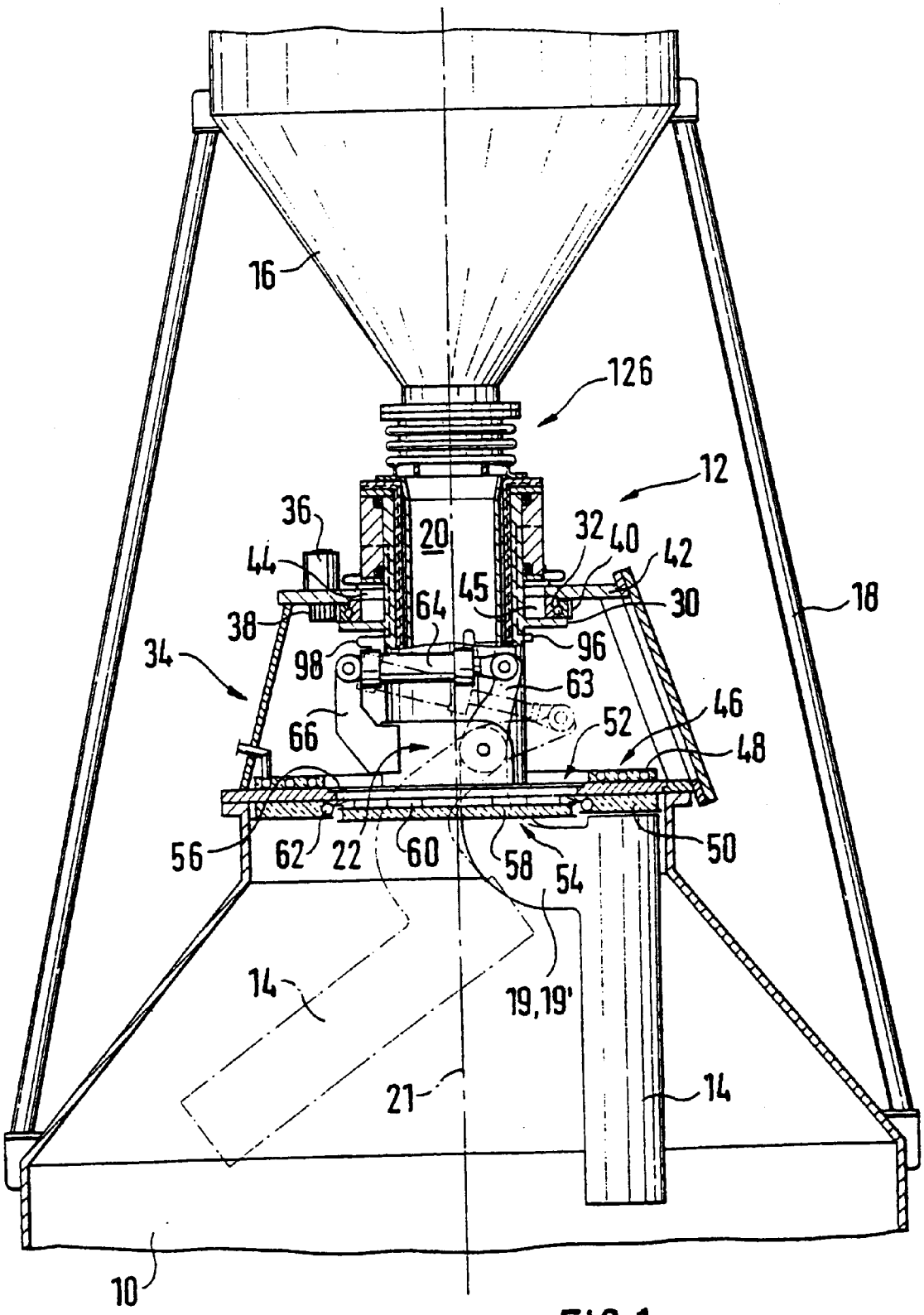
FIG. 1: a vertical cross-section through an installation for charging a shaft furnace provided with a device for distributing materials in bulk with a rotary chute having a variable angle of inclination according to the invention.

FIG. 1 shows a diagrammatic representation of an installation for charging a shaft furnace 10. This installation is provided with a device for distributing materials in bulk 12 with a rotary chute 14 having a variable angle of inclination. Above the distributing device 12 is positioned a batch hopper 16, which is supported by means of a supporting structure 18 on the shaft furnace 10. The hopper 16 opens into a feed channel 20. The reference number 21 indicates the central axis of the feed channel 20 which will normally be coaxial with the central axis of the shaft furnace 10.

In FIG. 1, the chute 14 is shown in two positions. The full lines show it in an almost vertical position, in which it is not operational. The material in bulk is in fact poured through the feed channel 20 into the central region of the shaft furnace 10. The broken lines show the chute 14 in an oblique position. In this position, the feed channel 20 pours the material in bulk into the rotary chute 14, which ensures that it is distributed inside the shaft furnace 10 as a function of its inclination.

Figure 2:
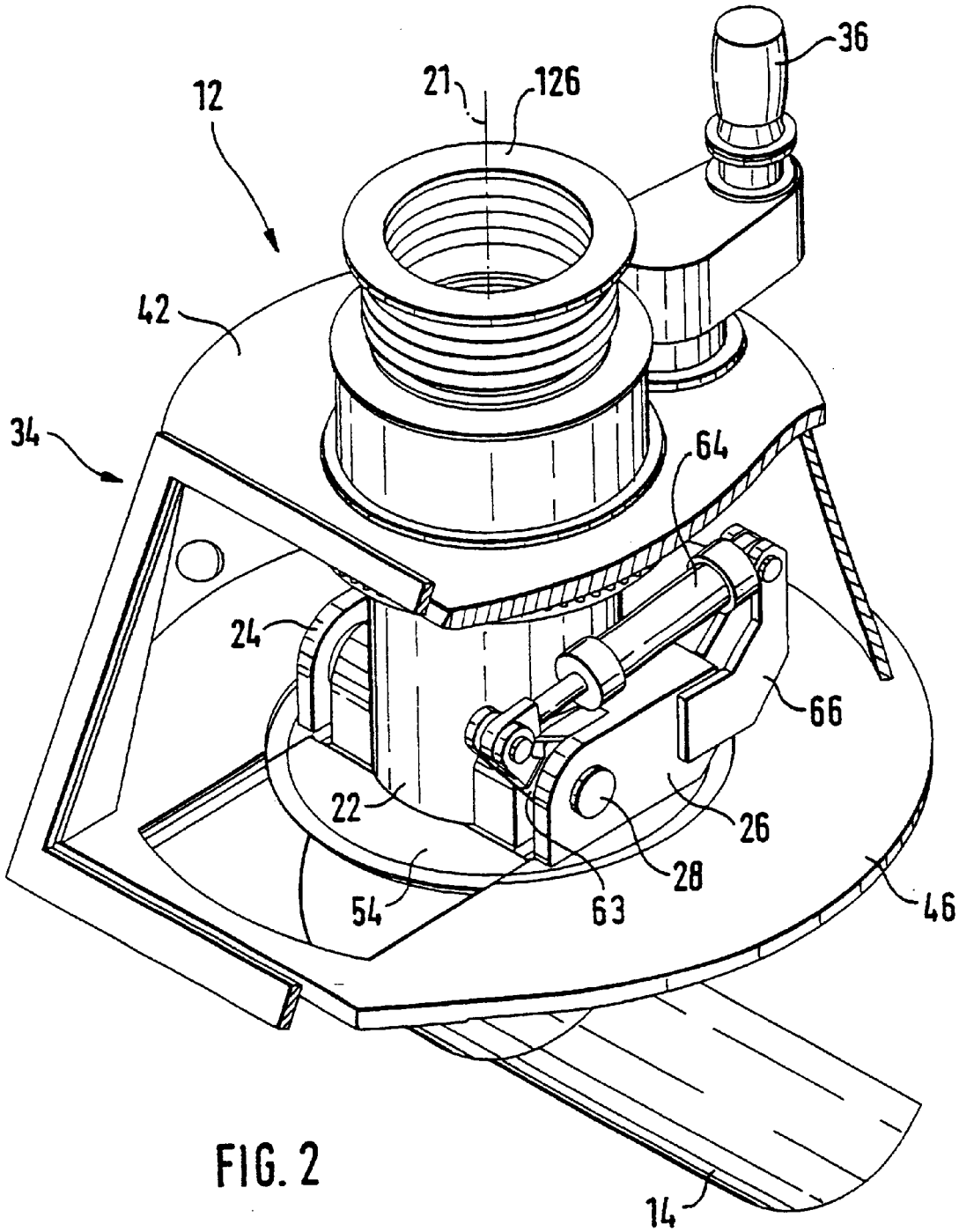
FIG. 2: a simplified three-dimensional view of a device for distributing materials in bulk according to the invention, drawn partly in the form of a cross-section.

The device for distributing materials in bulk 12 will now be studied in more detail by referring simultaneously to FIGS. 1 and 2. The chute 14 is provided at its upper end with two lateral suspension arms 19, 19' (in FIG. 1, the arm 19' is hidden by the arm 19). A suspension rotor 22 supports two suspension bearings 24, 26. In each of these two suspension bearings 24, 26 is mounted a suspension arm 19, 19' for the chute 14 so as to define for the chute 14 a substantially horizontal pivoting axis. In FIG. 2, it is possible to see a suspension journal 28 fixing a suspension arm of the chute 14 in the bearing 26. The other suspension arm is obviously fixed in the same way in the bearing 24.

The rotor 22, which carries at its lower end the bearings 24, 26, may be likened to a tube surrounding the feed channel 20. A large diameter bearing 32, which is mounted on a supporting flange 30 of the rotor 22, suspends the rotor 22 in a supporting structure 34 in such a way that the rotor 22 can rotate freely about the axis 21. An electric or hydraulic motor 36, preferably a motor with a variable speed of rotation, is used to drive in rotation the rotor 22, and hence also the chute 14, about the axis 21. For this purpose, a pinion 38 on the driving motor 36 meshes with an annular gear 40 carried by the supporting flange 30.

The structure 34, which is designed as a leak-proof housing, is itself supported on the head of the shaft furnace 10 and has at its upper end a plate 42 provided with an opening 44 for the passage of the upper end of the rotor 22. It should be noted that the supporting flange 30 and the bearing ring 32 seal off, towards the inside of the supporting structure 34, an annular space 45 bounded by the tubular wall of the rotor 22 in the opening 44 of the plate 42 in a leakproof or almost leak-proof way.

At its lower end the structure 34 is provided with an annular screen 46. Said screen is fitted with a cooling circuit 48 on its upper surface and with insulation 50 on its lower surface. The annular screen 46 defines a central opening 52 in which a screen flange 54 is set equipping the lower end of the suspension rotor 22. The screen flange 54 of the rotor 22 comprises an upper plate 56, which is protected at the bottom with insulation 58. Between the upper plate 56 and the insulation 58 there remains an empty space 60 accessible from the lateral edge of the screen flange 54. A pipe 62 is positioned along the free edge of the annular screen 46. This pipe 62 is connected to a source of coolant gas and it is provided along its entire length with outlets oriented so as to be able to inject this coolant gas through into the empty space 60 in the screen flange 54.

It can be seen in FIG. 2 that the chute 14 has at its upper end a pivoting arm 63. A hydraulic cylinder 64 is articulated between the pivoting arm 63 and a fixed arm 66 forming part of the bearing 26. By actuating this cylinder 64, the chute 14 is made to pivot in its bearings 24, 26. The hydraulic cylinder 64 is supplied with a pressurised hydraulic fluid using a rotary annular connecting device surrounding the feed channel 20 of the chute 14.

A first embodiment of such a rotary annular connection will be described using FIG. 3. This rotary connection 68 comprises a non-rotatable sleeve 70 and a rotary sleeve 72 driven in rotation by the rotor 22. In the embodiment shown, the rotary sleeve 72 is formed by an extension of the tube forming the rotor 22 above the plate 42. The non-rotatable sleeve 70 is supported by the rotary sleeve 72 using two roller bearings 74 and 76. A flexible annular expansion joint 78 connects the sleeve 70 to the plate 42 of the supporting structure 34. This expansion joint 78 prevents the sleeve 70 from rotating and contributes to the leak-proof sealing-off of the annular space 45 while allowing slight movements of the sleeve with respect to the supporting structure 34. It remains to point out that the injection of a pressurised gas into the annular space 45 makes it possible to prevent smoke entering through the bearing 32 into the annular space 45. The rotary connecting device 68 is thus protected from the unfavourable environment (heat, corrosive smoke and vapours, dust) which may still prevail inside the supporting structure 34, despite the screens 46 and 54 provided at the lower end of the supporting structure 34.

Flexible pipes, represented diagrammatically by lines 80', 82' along their axes, connect the non-rotatable sleeve 70 by means of these connections 80, 82 to a non-rotatable hydraulic control circuit, represented diagrammatically by the block 79. This circuit 79 may be a hydraulic circuit used conventionally for controlling a double-acting piston. The arrows pointing in opposite directions and the letters P and T indicate that the hydraulic circuit 79 may connect the connections 80 and 82 alternately to a source of pressure P or to a reservoir T.

The connection 80 opens into a supply channel 84 and the connection 82 into a supply channel 86, which are both machined in a radial direction in the inner cylindrical surface of the sleeve 70. (They could, however, further be machined in the outer cylindrical surface of the sleeve 72.) The reference number 88 refers to a first channel for the supply of hydraulic fluid in the rotor 22. This channel 88 has an outlet 90 in the outer cylindrical surface of the sleeve 72 at the level of the supply channel 84. Similarly, a second channel 92 has an outlet 94 at the level of the supply channel 86. It follows from this that each of the channels 88, 92 in the rotary sleeve 72 is permanently in hydraulic communication with the corresponding supply channel 84, 86 in the nonrotatable sleeve 70. In other words, through the connections 80, 82, the supply channels 84, 86, the outlets 90, 94 and the channels 88, 92, it is possible to supply, in a closed circuit, hydraulic equipment on the rotor 22 with a pressurised hydraulic fluid. FIG. 1 shows a diagrammatic representation of the flexible pipes 96, 98 which connect the channels 88, 92 to the hydraulic cylinder 64.

Figure 3:
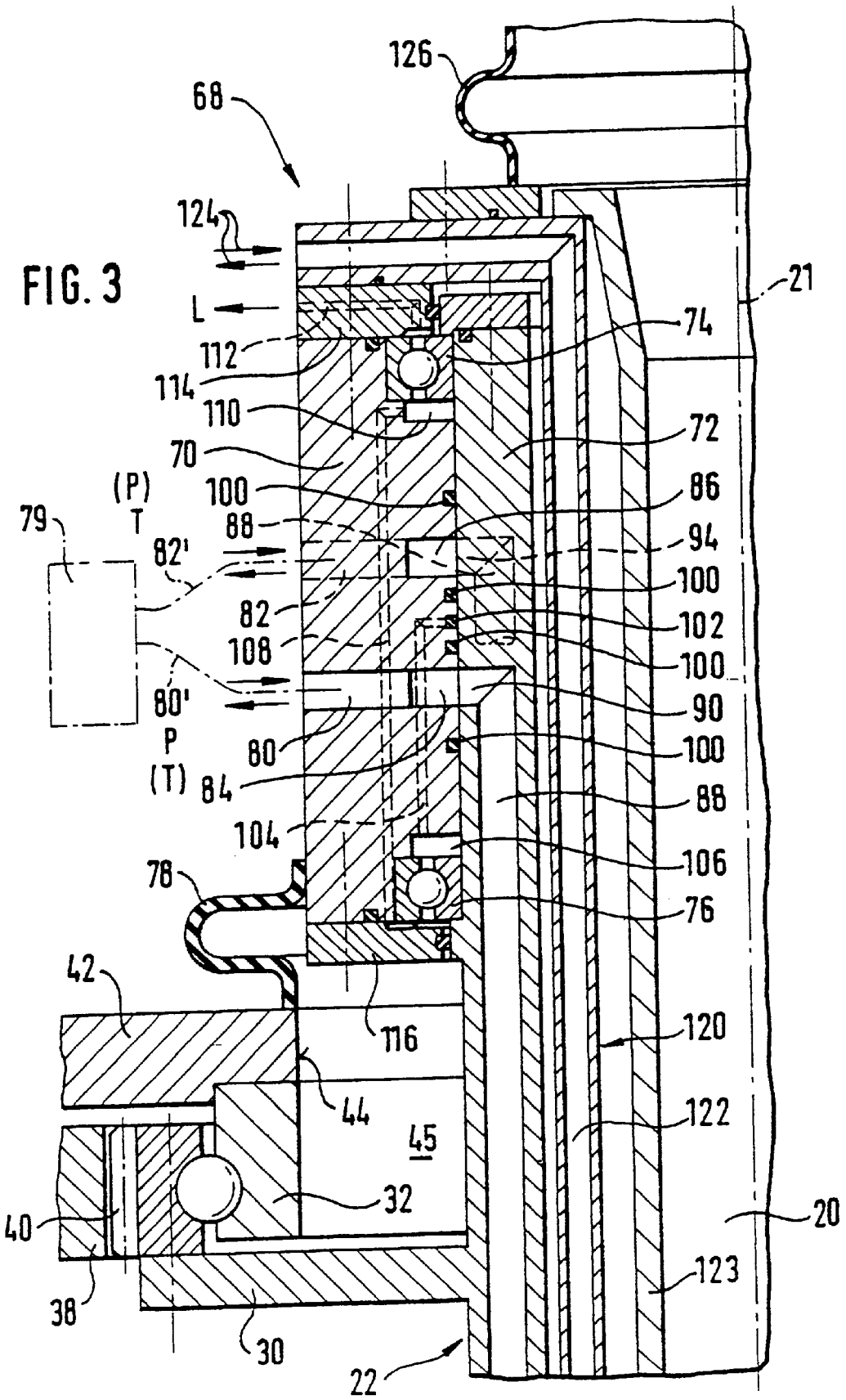
FIG. 3: a diagrammatic cross-section through a first embodiment of an annular connecting device provided in a device for distributing materials in bulk according to the invention.

In the embodiment of FIG. 3, each of the supply channels 84, 86 has sealing rings 100 running alongside them. However, said sealing rings cannot guarantee that the sealing between the non-rotatable sleeve 70 and the rotary sleeve 72 is perfect, so that an axial leakage flow is set up between the two sleeves 70 and 72. It should be appreciated that this axial leakage flow is advantageously used to lubricate the roller bearings 74 and 76. For this purpose, a third supply channel 102 is provided between the two supply channels 84, 86. This supply channel 102 is used to collect the leakage flow between the two supply channels 84, 86 in order to discharge it through a channel 104 into a lubrication chamber 106 for the roller bearing 76. This chamber 106 further receives the leakage flow passing through the sealing ring 100 located below the supply channel 84. After having lubricated the roller bearing 76, the axial leakage flow collected in the chamber 106 passes through a channel 108 into a lubrication chamber 110 for the roller bearing 74. This chamber 110 further receives the leakage flow passing through the sealing ring 100 located above the supply channel 86. After having lubricated the roller bearing 74, the leakage flow is finally discharged through a channel 112 outside the rotary connection 68. A sealing collar 114, 116 fixed to the non-rotatable sleeve 70 provides for some sealing between the non-rotatable sleeve 70 and the rotary sleeve 72, respectively, above the upper roller bearing 74 (as regards the sealing collar 114) and below the lower roller bearing 76 (as with regards to the sealing collar 116).

The reference number 120 refers generally to a non-rotatable screen equipped with a closed cooling circuit 122. This cooling screen 120 is mounted in an annular space remaining between the rotary sleeve 72 of the rotary connection 68 and a fixed wearing tube 123 forming the feed channel 20. It mainly serves to cool the inner surface of the rotor 22. The arrows 124 stand for a cooling liquid passing through the closed cooling circuit 122. The cooling sleeve 120 and the wearing tube 123 are both supported by the non-rotatable sleeve 70. An expansion joint 126, which can be seen more clearly in FIGS. 1 and 2, connects the feed channel 20 in a gastight manner to the batch hopper 16.

Figure 6:
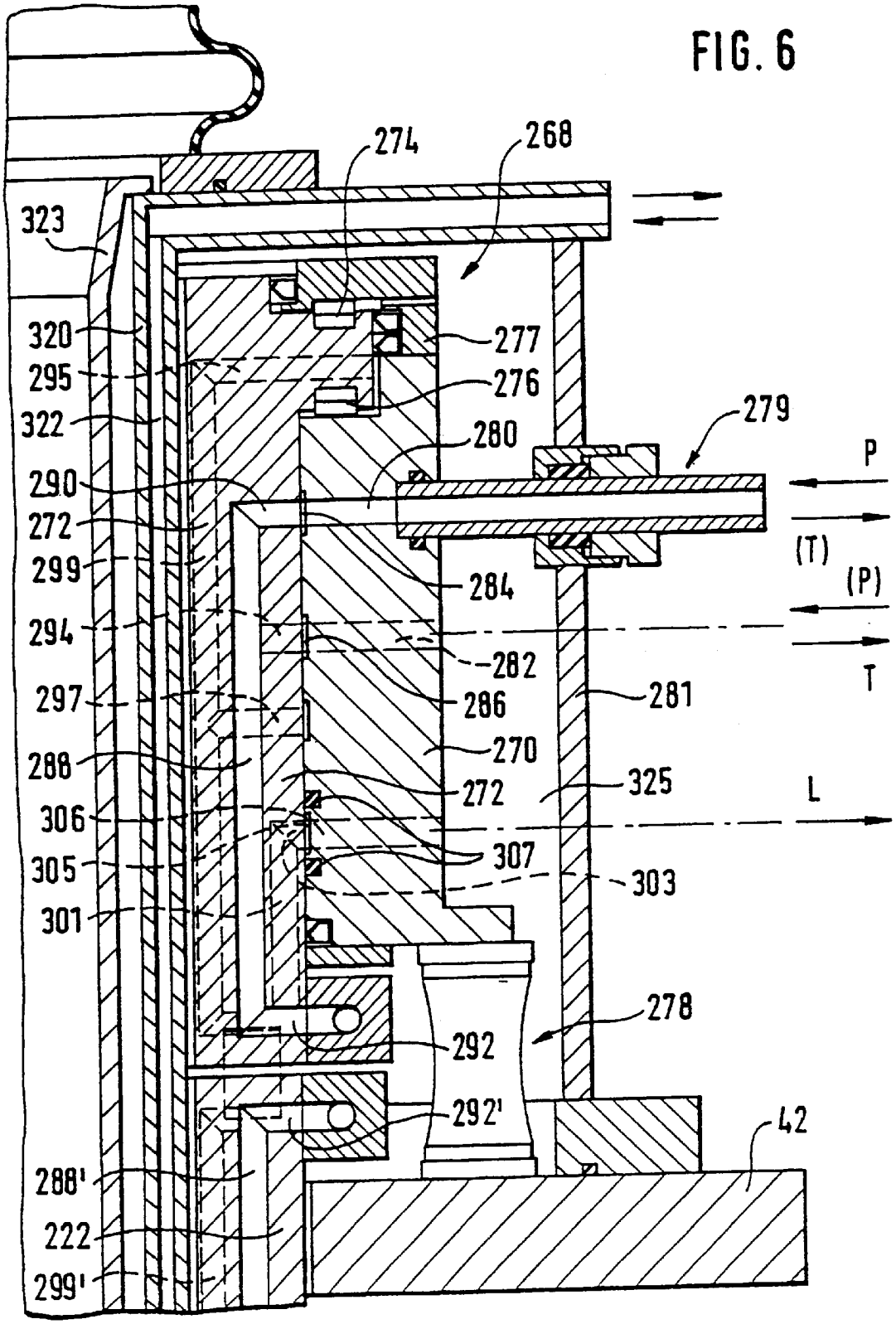
FIG. 6: a diagrammatic cross-section through a second embodiment of an annular connecting device provided in a device for distributing materials in bulk according to the invention.
Figure 7:
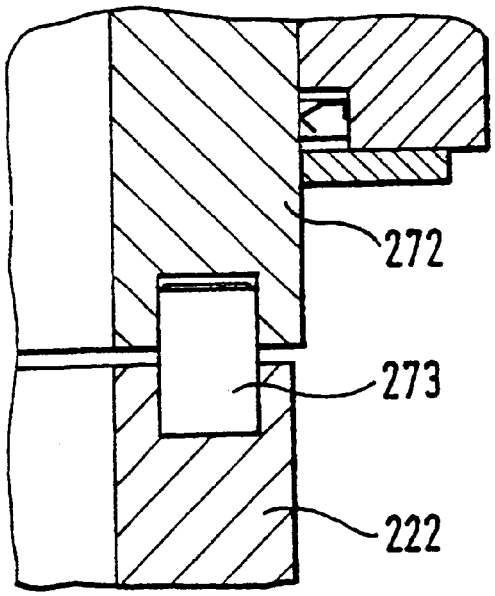
FIG. 7: a cross-section showing an enlarged detail from FIG. 6.
Figure 8:
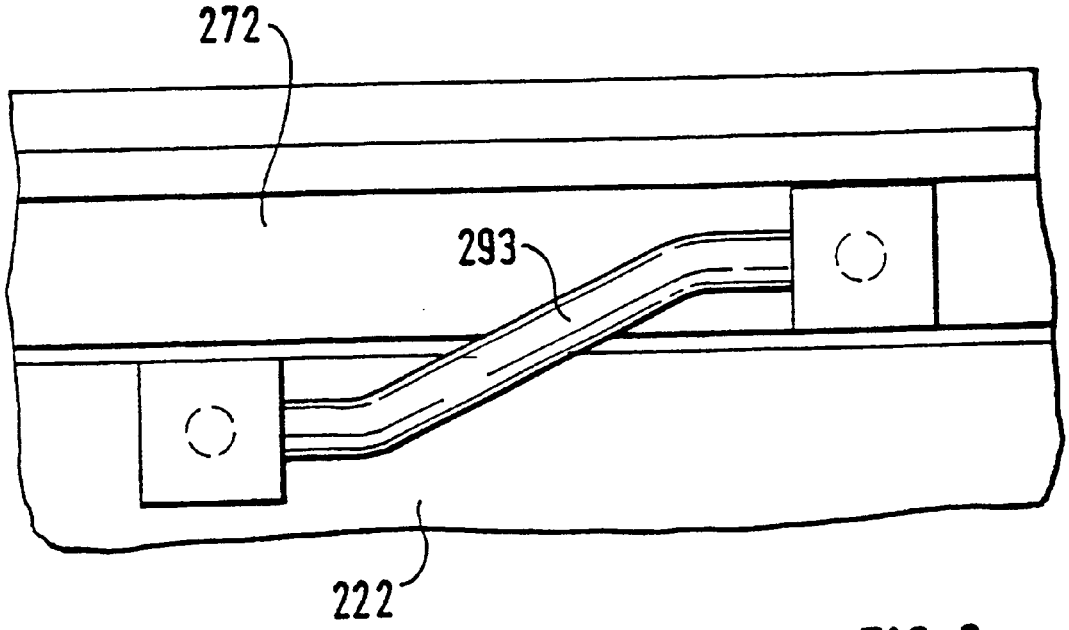
FIG. 8: a view of a detail from FIG. 6.

A second embodiment of an annular rotary connection will be described with the help of FIGS. 6 to 8. This rotary connection 268 comprises a non-rotatable sleeve 270 and a rotary sleeve 272 driven in rotation by a suspension rotor 222, which is equivalent to the suspension rotor 22. The upper end of the rotor 222 protrudes only slightly with respect to the upper plate 42 of the structure 34. The rotary sleeve 272 is located above this upper end of the rotor 222 and is coupled to it by dowels 273 (see FIG. 7). These dowels 273 enable the rotor 222 to drive in rotation the rotary sleeve 272, while allowing some freedom as regards small relative movements between the rotor 222 and the sleeve 272. It should further be appreciated that this arrangement enables the rotary connection 268 to be exchanged en bloc without having to remove the rotor 222.

The non-rotatable sleeve 270 is supported flexibly on the plate 42 by means of elastic supports 278. The rotary sleeve 272 is supported in the non-rotatable sleeve 270 by means of thrust bearings 274, 276 which cooperate, for example, with a flange 277 on the rotary sleeve 272.

The reference number 279 refers to at least two connections making it possible to connect the rotary connection 268 to a hydraulic circuit (not shown). This connection 279 passes in a gastight manner through a fixed wall 281 which surrounds the rotary connection 268. It can be seen that the connection 279 is designed so as not to impede small movements of the sleeve 270 on its elastic supports 278. A connecting channel 280 connects the first connection 279 to a supply channel 284. A connecting channel 282, located outside the cross-sectional plane of FIG. 6, connects the second connection (not shown) to a supply channel 286. The supply channels 284 and 286 are both machined in a radial direction in the inner cylindrical surface of the sleeve 270. (Further, the supply channels 284, 286 could be machined in the outer cylindrical surface of the sleeve 272.) The reference number 288 refers to a feed channel for hydraulic fluid in the rotor 222. This channel 288 has an outlet 290 in the outer cylindrical surface of the sleeve 272 at the level of the supply channel 284. A second channel 292 (located outside the cross-sectional plane) similarly has an outlet 294 at the level of the supply channel 286. It follows from this that each of the channels 288, 292 is permanently in hydraulic communication with the corresponding supply channel 284, 286 in the non-rotatable sleeve 270.

At the lower end of the rotary sleeve 272, each of the channels 288, 292 is connected through a flexible pipe to a distribution channel 288', 292' made in the rotor 222. FIG. 8 shows such a flexible pipe 293. It should be noted that it lies along the joint between the rotary sleeve 272 and the rotor 222 over a certain distance in order to have a greater deformable length, and thus a better flexibility, in order to compensate for relative movements between the rotary sleeve 272 and the rotor 222. In conclusion, through the connecting channels 280, 282, the supply channels 284, 286, the outlets 290, 294, the channels 288, 292, the flexible pipes 293 and the distribution channels 288', 292', it is possible to supply hydraulic equipment, which is locked in rotation to the rotor 222, with a pressurized hydraulic fluid.

It should be pointed out that a fairly large leakage flow escapes laterally from whichever of the two supply channels 284 or 286 is supplied with the pressurized hydraulic fluid. This pressurized leakage flow penetrates wedge-shaped annular slits made between the two sleeves 270, 272 on both sides of the supply channels 284, 286 and causes a hydrostatic self-centring of the rotary sleeve 272 in the non-rotatable sleeve 270. At the same time, it provides an optimum cooling of the two sleeves 270 and 272.

It is further possible to use the aforesaid leakage flow as a liquid for supplying the closed cooling circuits which are locked in rotation to the rotor 222. For this purpose, the rotary sleeve 272 incorporates, for example, drainage means 295, 297, which are located respectively above and below the two supply channels 284, 286 so as to collect the leakage flow from the adjacent supply channel 284, 286. These drainage means 295, 297 open into a supply channel 299 made in the rotary sleeve 272. At the lower end of the rotary sleeve 272, the supply channel 299 is connected through a flexible pipe (see, for example, FIG. 8) to a distribution channel 299' made in the rotor 222. This distribution channel 299' makes it possible to supply a cooling circuit locked in rotation with the rotor 222 with the hydraulic leakage flow as cooling fluid. The reference number 301 refers to a return channel for this cooling fluid in the rotary sleeve 272, which is connected in the way described above to a return channel of the cooling circuit locked in rotation with the rotor 222. The return channel has an outlet 303 at the level of a supply channel 305 machined in a radial direction in the inner cylindrical surface of the sleeve 270. This supply channel 305 has a sealing ring 307 running alongside it and it opens into a channel 306 for discharging the leakage flow into a reservoir (not shown). It remains to point out that a part of the leakage flow is advantageously used to lubricate the thrust bearing 274, while the thrust bearing 276 has a separate lubricating system.

The reference number 320 refers generally to a non-rotatable screen equipped with a cooling circuit 322. This non-rotatable screen 320 is equivalent to the non-rotatable screen 120 of FIG. 3. It is supported, together with a wearing tube 323 defining the feed channel 20, by the fixed wall 281 and forms with said wall an annular chamber 325 in which the rotary connection 268 is housed. This arrangement has the particular advantage that the vibrations absorbed by the wearing tube 323 during the passage of the charging material in the channel 20 are not transmitted to the rotary connection 268.

Figure 4:
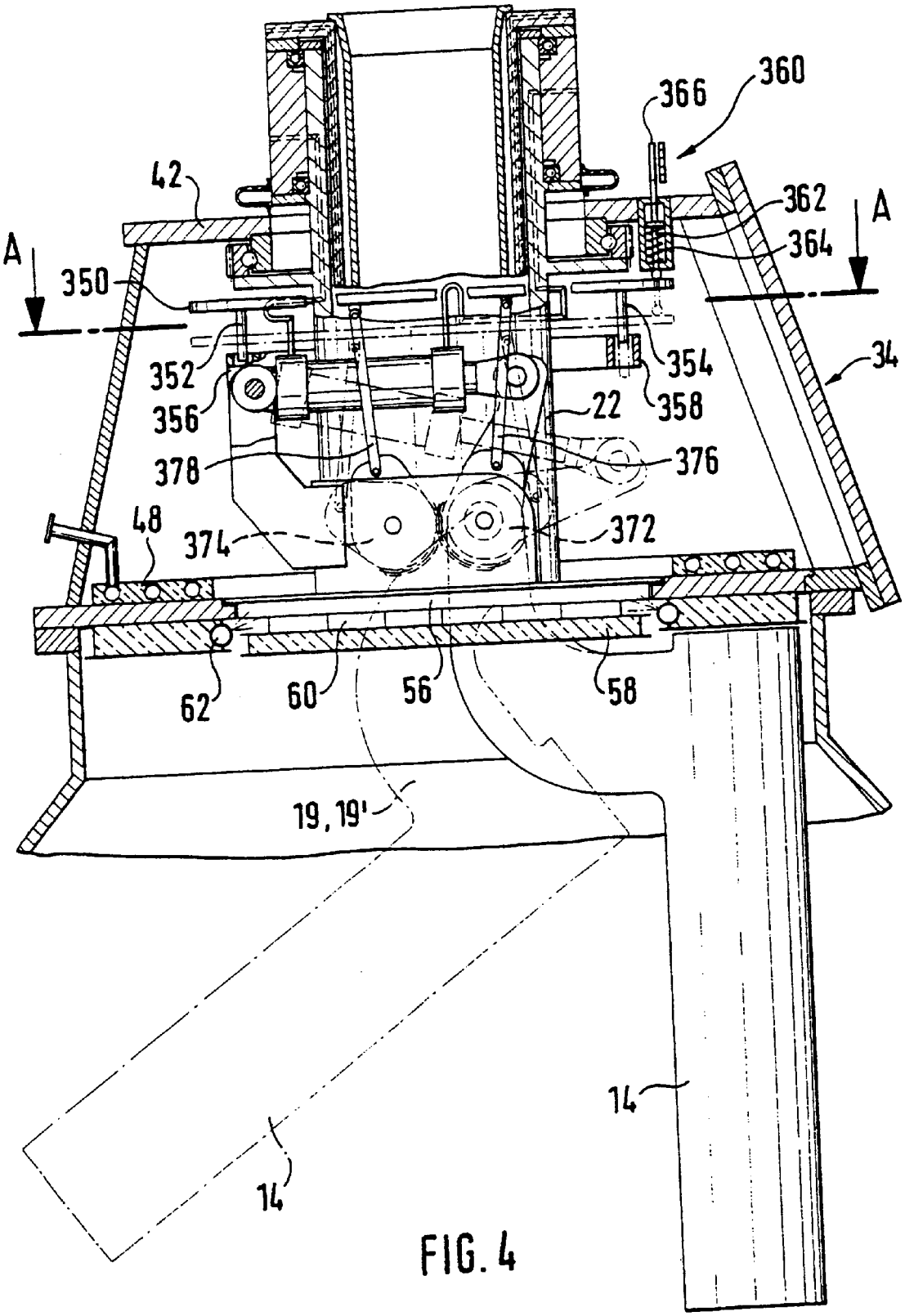
FIG. 4: a diagrammatic cross-section through a device for distributing materials in bulk with a rotary chute having a variable angle of inclination provided with a device for indicating the angle of inclination of the chute.
Figure 5:
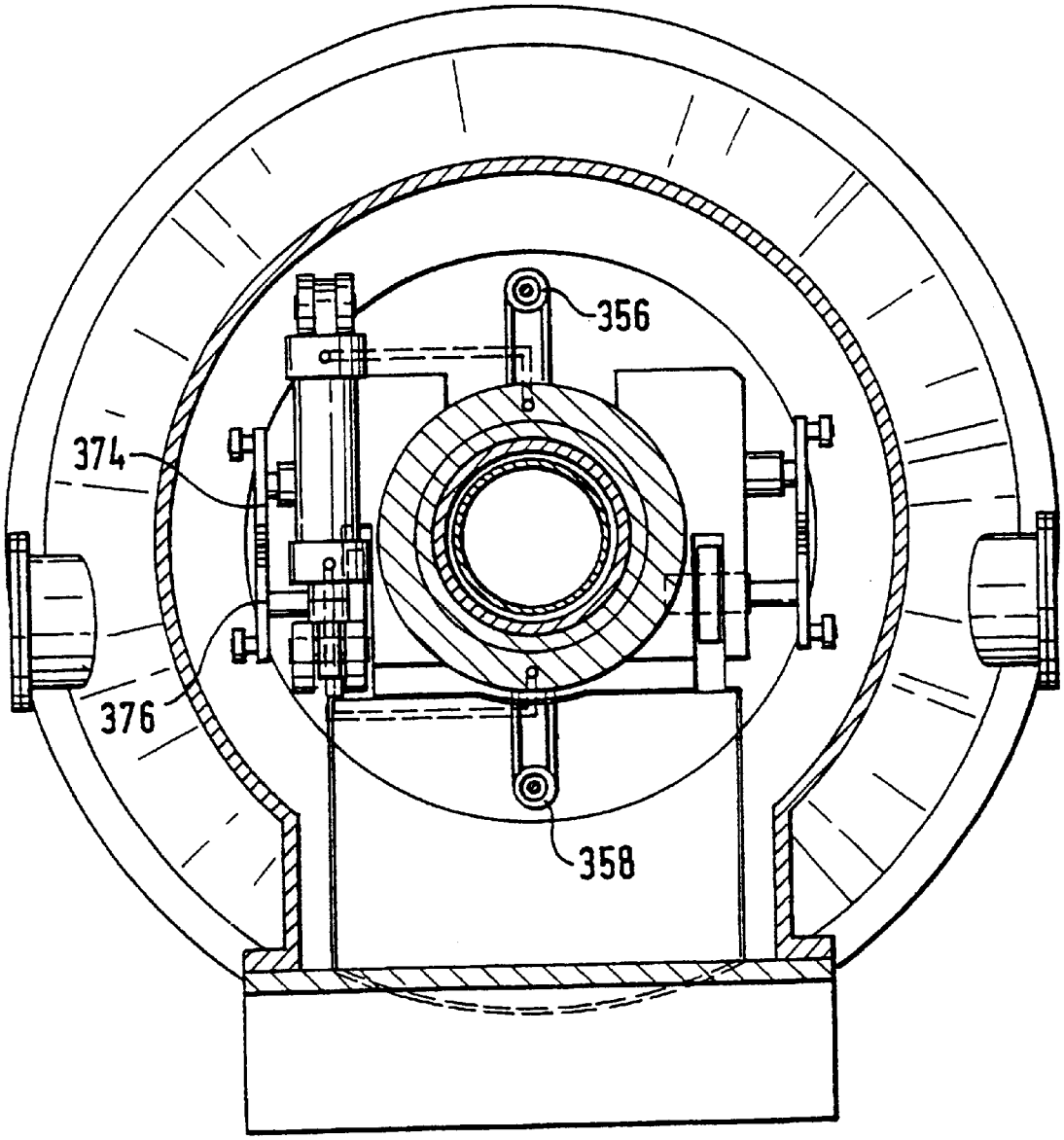
FIG. 5: a cross-section along the cutting line A—A in FIG. 4.

FIGS. 4 and 5 serve to illustrate a device for indicating the inclination of the chute, which can be advantageously used in a device for distributing material in bulk with a rotary chute having a variable angle of inclination. The reference number 350 refers to a roughly horizontal ring mounted on the suspension rotor 22 so that it can slide vertically along said rotor. For this purpose, the ring 350 is, for example, provided with guide rods 352, 354 which are received in slides 356, 358 carried by the rotor 22. A connection mechanism connects this ring 350 to the chute 14 so that a pivoting of the chute 14 causes a vertical displacement of the ring 350. It follows from this that the vertical position of the ring 350 is a function of the inclination of the chute 14. The reference number 360 refers generally to a position detector 360, which is mounted on the upper plate 42 of the supporting structure 34 to detect the vertical position of the ring 350. This detector 360 is, for example, provided with a detecting rod 362 which penetrates the structure 34 so that it can bear with its front end against the ring 350 rotating with the rotor 22. A spring 364 ensures a permanent contact between the front end of the rod 362 and the rotating ring 350. It follows from this that the length of the rear end 366 of the rod 362 which emerges from the supporting structure 34 is a faithful image of the vertical position of the ring 350 and hence of the inclination of the chute 14. In a preferred embodiment, the connection mechanism which connects the ring 350 to the chute 14 consists, on each suspension arm 19, 19' of the chute 14, of a pair of toothed segments 372, 374 which mesh together. The toothed segment 372 is fixed to the chute so that its axis is coincident with the pivoting axis of said chute. The toothed segment 374 is mounted on the rotor 22 so that it can rotate freely about an axis parallel to the pivoting axis of the chute 14. Each toothed segment 372, 374 is connected by an articulated linking rod 376, 378 to the ring 350. It should be appreciated that this mechanism ensures a parallel displacement of the ring 350 when the chute 14 pivots about its pivoting axis.

What is claimed is:

1. A device for distributing materials in bulk comprising:

a supporting structure;

a chute for the delivery of materials in bulk;

a suspension rotor mounted in said supporting structure in such a way that it can rotate about a substantially vertical rotation axis, said chute being suspended from said suspension rotor so that it can pivot about a substantially horizontal suspension axis;

a pivoting mechanism to make said chute pivot about its suspension axis so as to change an inclination of said chute, said pivoting mechanism for said chute including:

a hydraulic motor mounted on said suspension rotor and connected to said chute so as to be able to make it pivot about its suspension axis;

a non-rotatable hydraulic control circuit for said hydraulic motor; and a hydraulic connecting device comprising a non-rotatable sleeve and a rotary sleeve driven in rotation by said rotor, said sleeves co-operating to connect said hydraulic motor on said suspension rotor to said non-rotatable hydraulic control circuit; and a feed channel for said chute, said feed channel passing axially through said suspension rotor and through said sleeves.

2. The device according to claim 1, wherein:

said supporting structure is designed as a gastight housing;

said suspension rotor has an upper end that is led out of said gastight housing in a substantially gastight manner; and said annular hydraulic connecting device is located above said gastight housing.

3. The device according to claim 2, wherein said hydraulic connecting device further comprises flexible pipes supplying said non-rotatable sleeve with a pressurized hydraulic liquid.

4. The device according to claim 2, wherein said hydraulic connecting device further comprises a flexible annular expansion joint, which connects said non-rotatable sleeve in a gastight manner to said supporting structure.

5. The device according to claim 4, wherein said hydraulic connecting device further includes flexible pipes connecting said rotary sleeve to a hydraulic distribution circuit on said suspension rotor.

6. The device according to claim 4, herein for the transfer of the hydraulic liquid between said non-rotatable sleeve and said rotary sleeve, said hydraulic connecting device comprises:

superposed supply channels for the transfer of the hydraulic fluid for running said hydraulic motor;

drainage means located respectively above and below said supply channels so as to collect the leakage flow from said adjacent supply channel.

7. The device according to claim 6, further comprising:

at least one cooling circuit in rotation with said suspension rotor; and a hydraulic circuit on said rotary sleeve, said hydraulic circuit communicating with said drainage means and supplying said at least one cooling circuit.

8. The device according to claim 1, wherein said rotary sleeve is supported by said suspension rotor and said non-rotatable sleeve is supported by said rotary sleeve.

9. The device according to claim 8, wherein said hydraulic connecting device further comprises bearing means supporting said non-rotatable sleeve on said rotary sleeve.

10. The device according to claim 9, wherein said bearing means comprises two annular bearings.

11. The device according to claim 1, wherein said non-rotatable sleeve is supported flexibly by said supporting structure and said rotary sleeve is supported by said non-rotatable sleeve.

12. The device according to claim 11, wherein said hydraulic connecting device further comprises elastic supports supporting said non-rotatable sleeve on said supporting structure.

13. The device according to claim 11, wherein said hydraulic connecting device further comprises means for transmitting a driving torque from said suspension rotor to said rotary sleeve, while allowing relative translations of said rotary sleeve with respect to said suspension rotor.

14. The device according to claim 11, wherein said non-rotatable sleeve and said rotary sleeve have a fit designed so that a pressurized hydraulic fluid injected therebetween warrants a hydrostatic self-centering of said rotary sleeve in said non-rotatable sleeve.

15. The device according to claim 14, further comprising thrust bearings to support said rotary sleeve axially in said non-rotatable sleeve.

16. The device according to claim 1, further comprising a non-rotatable tubular screen inserted between said feed channel and said hydraulic connecting device, said non-rotatable screen being equipped with a cooling circuit.

17. The device according to claim 16, wherein said tubular screen is supported by an outer wall of said supporting structure so as to form with said outer wall an annular chamber in which the annular hydraulic connection is housed.

18. The device according to claim 1, wherein:

said supporting structure is provided at its lower end with a fixed annular screen equipped with a cooling circuit and defining a central circular opening, said suspension rotor is equipped at its lower end with a flange which is fitted with clearance in said central circular opening and has an empty space opening into its lateral edge; and a gas injection pipe is located along a free edge of said fixed annular screen so as to be able to inject a coolant gas into said empty space of said flange.

19. The device according to claim 1, further comprising a device for indicating the inclination of said chute.

20. The device according to claims 19, wherein said device for indicating the inclination of said chute comprises:

a substantially horizontal ring mounted on said suspension rotor around said feed channel, so as to be vertically movable on said suspension rotor;

a connecting mechanism connecting said ring to said chute so that a pivoting of said chute brings about a vertical displacement of said ring; and a detector mounted on said supporting structure, said detector being provided with a detection rod penetrating said supporting structure in order to bear against said ring so as to detect its height inside said supporting structure.

21. The device according to claim 20, wherein said connecting mechanism comprises:

at least one pair of toothed segments which mesh with each other, a first of the toothed segments being fixed to said chute so as to have its axis coincident with the pivoting axis of said chute, a second of the toothed segments being mounted on said rotor so as to be able to rotate freely about an axis parallel to the pivoting axis of said chute; and one supporting linking rod per respective toothed segment, said supporting linking rod connecting said respective toothed segment to said ring.

22. The device according to claim 1, wherein said hydraulic motor is a hydraulic cylinder.

* * * * *